US009207568B2

(12) United States Patent
Lee et al.

(10) Patent No.: US 9,207,568 B2
(45) Date of Patent: Dec. 8, 2015

(54) DEVELOPING UNIT ADOPTING A TWO COMPONENT AGENT AND ELECTROPHOTOGRAPHIC IMAGE FORMING APPARATUS EMPLOYING THE SAME

(71) Applicant: Samsung Electronics Co., Ltd., Suwon-si (KR)

(72) Inventors: Ho-young Lee, Suwon-si (KR); Mitsuru Oikawa, Suwon-si (KR); Jong-hyun Park, Hwaseong-si (KR); Sang-hoon Lee, Suwon-si (KR); Jun-hee Lee, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/182,518

(22) Filed: Feb. 18, 2014

(65) Prior Publication Data

US 2015/0037074 A1 Feb. 5, 2015

(30) Foreign Application Priority Data

Jul. 31, 2013 (KR) ..... 10-2013-0091170

(51) Int. Cl.
*G03G 15/08* (2006.01)
*G03G 15/09* (2006.01)

(52) U.S. Cl.
CPC ..... *G03G 15/0812* (2013.01); *G03G 15/081* (2013.01); *G03G 15/0921* (2013.01); *G03G 2215/0609* (2013.01)

(58) Field of Classification Search
CPC ..... G03G 15/0812; G03G 15/081; G03G 15/0921; G03G 2215/0609
USPC ..... 399/272, 274
See application file for complete search history.

(56) References Cited

U.S. PATENT DOCUMENTS 4,194,830 A 3/1980 Ohnuma et al.
4,636,057 A * 1/1987 Iida et al.

(Continued)

FOREIGN PATENT DOCUMENTS

EP 1666983 6/2006
JP 2003-5513 1/2003

(Continued)

OTHER PUBLICATIONS

Korean Office Action issued Aug. 28, 2014 in Korean Patent Application No. 10-2013-0091170.

(Continued)

*Primary Examiner* — David Gray
*Assistant Examiner* — Laura Roth
(74) *Attorney, Agent, or Firm* — Staas & Halsey LLP

(57) ABSTRACT

A developing unit employing a two-component developing agent is shown. The developing unit includes a first regulating member, a second regulating member, and a third regulating member forming first, second, and third regulating gaps respectively with a developing roller. The third regulating member forms a recovery path for recovering excessive developing agent that may not pass through the first and second regulating gaps to an agitating region between the third and second regulating members. A distance between a vertical line passing through an upstream side end portion of the second regulating member based on a rotating direction of the developing roller and a center of the developing roller is greater than a radius of the developing roller, and a downstream end of the third regulating member is located between a regulating pole and a catch pole.

21 Claims, 8 Drawing Sheets

(56) References Cited

U.S. PATENT DOCUMENTS

| | | | | |
|---|---|---|---|---|
| 6,070,037 | A * | 5/2000 | Sugihara et al. | 399/274 |
| 8,639,167 | B2 | 1/2014 | Nakayama et al. | |
| 8,670,698 | B2 | 3/2014 | Park | |
| 2003/0086728 | A1 | 5/2003 | Kikuchi | |
| 2011/0150539 | A1 | 6/2011 | Mabuchi et al. | |
| 2012/0003014 | A1 | 1/2012 | Nakayama et al. | |
| 2013/0164045 | A1 * | 6/2013 | Onoda et al. | 399/274 |

FOREIGN PATENT DOCUMENTS

| | | |
|---|---|---|
| JP | 2011-59382 | 3/2011 |
| JP | 2012-14086 | 1/2012 |
| JP | 5299365 | 9/2013 |
| KR | 10-2012-0015189 | 2/2012 |

OTHER PUBLICATIONS

Extended European Search Report dated May 15, 2014 in European Patent Application No. 14154930.3.

Korean Notice of Allowance issued May 19, 2015 in Korean Patent Application No. 10-2013-0091170.

* cited by examiner

DEVELOPING UNIT ADOPTING A TWO COMPONENT AGENT AND ELECTROPHOTOGRAPHIC IMAGE FORMING APPARATUS EMPLOYING THE SAME

CROSS-REFERENCE TO RELATED APPLICATIONS

This application claims the priority benefit of Korean Patent Application No. 10-2013-0091170, filed on Jul. 31, 2013, in the Korean Intellectual Property Office, the disclosure of which is incorporated herein in its entirety by reference.

BACKGROUND

1. Field

One or more embodiments relate to a developing unit adopting a two-component developing agent including a toner and a magnetic carrier, and an image forming apparatus employing the developing unit.

2. Description of the Related Art

In electrophotographic image forming apparatuses, an electrostatic latent image is formed on a surface of a photosensitive body by scanning light that is modulated according to image information onto the photosensitive body, the electrostatic latent image is developed into a visible toner image by supplying toner to the electrostatic latent image, and the toner image is transferred to a recording medium and fused thereto so that an image is printed on the recording medium.

The electrophotographic image forming apparatuses may use a one-component developing type using a one-component developing agent containing a toner, or a two-component developing type using a two-component developing agent, in which a toner and a carrier are mixed, and developing toner only onto a photosensitive body.

In an image forming apparatus of the two-component developing type, a thickness of a developing agent attached to an outer circumference of a developing roller is regulated by a regulation member that is a predetermined distance apart from the outer circumference of the developing roller. In order to obtain printing images of high quality, a thickness of the developing agent layer that is supplied to a developing region where the developing roller and a photosensitive body face each other has to be uniform in an axial direction of the developing roller. If the thickness of the developing agent layer is not uniform, smudges in image concentration and dispersion of the toner may occur. Also, if a developer mass per area (DMA) on the surface of the developing roller is excessively changed within a lifespan period of the developing agent, wherein the developing agent is regulated by the regulation member and supplied to the developing region, stable image quality may not be maintained.

SUMMARY

In an aspect of one or more embodiments, there is provided a developing unit capable of supplying a developing agent to a developing region where a photosensitive body and a developing member face each other by attaching the developing agent onto a surface of the developing member, and an image forming apparatus employing the developing unit.

Additional aspects will be set forth in part in the description which follows and, in part, will be apparent from the description, or may be learned by practice of the presented embodiments.

According to an aspect of one or more embodiments, there is provided a developing unit for supplying a toner in a developing agent, in which the toner and a carrier are mixed, to an electrostatic latent image formed on an image carrier, and which includes: an agitating region in which the developing agent is agitated; a developing member which supplies the toner to the image carrier by attaching the developing agent on an outer circumference thereof, and which includes a rotating sleeve, and a magnetic pole member including a regulating pole and a catch pole disposed on an upstream side of the regulating pole for attaching the developing agent to an outer circumference of the sleeve and disposed inside the sleeve; a first regulating member which faces the regulating pole to form a first regulating gap between the first regulating member and the outer circumference of the sleeve; a second regulating member which forms a second regulating gap at an upstream side of the first regulating gap based on a rotating direction of the developing member, between the second regulating member and the outer circumference of the sleeve; and a third regulating member which forms a third regulating gap at an upstream side of the second regulating gap, between the third regulating member and the outer circumference of the sleeve, and which forms a recovery path for recovering excessive developing agent that may not pass through the first and second regulating gaps; wherein a distance between a vertical line passing through an upstream end of the second regulating member and a center of the developing member may be greater than a radius of the developing member, and a downstream end of the third regulating member is located between the regulating pole and the catch pole.

A downstream end of the third regulating member may be located within a range of ±10° based on a location where a vertical magnetic force between the regulating pole and the catch pole is lowest.

A horizontal line passing through the center of the developing member may be located between an upstream end of the second regulating member and the downstream end of the third regulating member.

The downstream end of the third regulating member may be disposed within a range of ±2 mm based on the vertical line in a horizontal direction.

The third regulating member may include a regulating surface forming the third regulating gap, and a guidance surface located at an opposite side to the regulating surface for guiding the excessive developing agent to the agitating region, and an angle of the guidance surface with respect to the horizontal line is 30° or greater.

An area of the regulating surface may be less than an area of the guidance surface.

According to an aspect of one or more embodiments, there is provided a developing unit for supplying a toner in a developing agent, in which the toner and a carrier are mixed, to an electrostatic latent image formed on an image carrier, and which includes: an agitating region in which the developing agent is agitated; a developing member which supplies the toner to the image carrier by attaching the developing agent on an outer circumference thereof, and which includes a rotating sleeve, and a magnetic pole member including a regulating pole and a catch pole disposed on an upstream side of the regulating pole for attaching the developing agent to an outer circumference of the sleeve and disposed inside the sleeve; a regulating member which faces the regulating pole, and which forms a regulating gap with the outer circumference of the developing member to regulate a thickness of a developing agent layer supplied to the image carrier; and a shielding member located at an upstream side of the regulating member based on a rotating direction of the sleeve so as to block an excessive developing agent pushed away by the regulating gap not to be attached to the catch pole; wherein an upstream end of the regulating member may be located above a horizontal line that crosses a center of the developing member, and a downstream end of the shielding member may be located between the regulating pole and the catch pole and below the horizontal line.

A distance between a vertical line passing through the upstream end of the regulating member and the center of the developing member may be greater than a radius of the developing member.

The shielding member may form a recovery path, through which the excessive developing agent is guided to the agitating region, between a downstream end of the shielding member and the upstream end of the regulating member.

The downstream end of the shielding member may be located within a range of ±10° based on a location where a vertical magnetic force between the regulating pole and the catch pole is the lowest.

The downstream end of the shielding regulating member may be disposed within a range of ±2 mm based on the vertical line in a horizontal direction.

The shielding member may include a regulating surface forming another regulating gap with the outer circumference of the developing member to regulate an amount of the developing agent attached to the outer circumference of the developing member by the catch pole, and a guidance surface located at an opposite side to the regulating surface for guiding the excessive developing agent to the agitating region, and an angle of the guidance surface with respect to the horizontal line is 30° or greater.

An area of the regulating surface may be less than an area of the guidance surface.

The regulating member may include a first regulating member facing the regulating pole to form a first regulating gap with the outer circumference of the sleeve, and a second regulating member forming a second regulating gap with the outer circumference of the sleeve at an upstream side of the first regulating gap based on the rotating direction of the developing member.

The second regulating gap may be greater than the first regulating gap.

A center portion of the second regulating gap in the length direction of the developing member may be greater than opposite ends of the second regulating gap.

According to an aspect of one or more embodiments, there is provided a developing unit for supplying a toner in a developing agent, in which the toner and a carrier are mixed, to an electrostatic latent image formed on an image carrier, and which includes: an agitating region in which the developing agent is agitated; a developing member which supplies the toner to the image carrier by attaching the developing agent on an outer circumference thereof, and including a rotating sleeve, and a magnetic pole member including a regulating pole and a catch pole disposed on an upstream side of the regulating pole for attaching the developing agent to an outer circumference of the sleeve and disposed inside the sleeve; a regulating member which faces the regulating pole to form a regulating gap with the outer circumference of the developing member and to regulate a thickness of a developing agent layer supplied to the image carrier; and another regulating member which is disposed between the regulating pole and the catch pole to form another regulating gap with the outer circumference of the developing member, wherein a downstream end of the another regulating member may be located with a range of ±10° based on a location where a vertical magnetic force between the regulating pole and the catch pole is the lowest, and the another regulating member may include a regulating surface forming the another regulating gap, and a guidance surface located at an opposite side to the regulating surface for guiding the excessive developing agent to the agitating region, and an area of the regulating surface is less than an area of the guidance surface.

According to an aspect of one or more embodiments, there is provided an electrophotographic image forming apparatus which uses a developing agent, in which a toner and a carrier are mixed, and which includes: an image carrier on which an electrostatic latent image is formed; and the above developing unit for supplying the toner to the electrostatic latent image to develop the electrostatic latent image.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
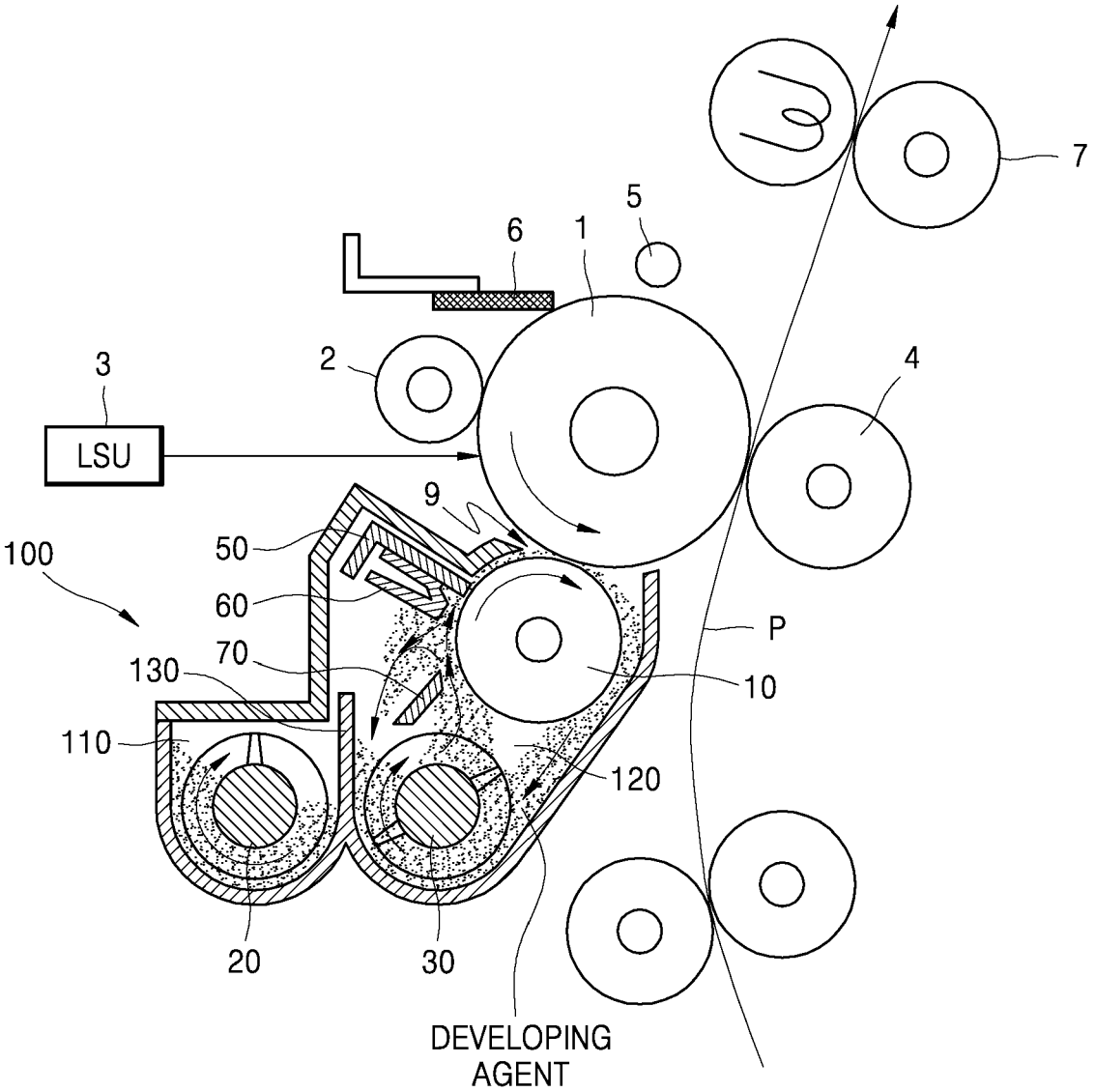
FIG. 1 is a block diagram of an electrophotographic image forming apparatus according to an embodiment.

Reference will now be made in detail to embodiments, examples of which are illustrated in the accompanying drawings, wherein like reference numerals refer to the like elements throughout. In this regard, embodiments may have different forms and should not be construed as being limited to the descriptions set forth herein.

FIG. 1 is a block diagram showing an electrophotographic image forming apparatus according to an embodiment. The image forming apparatus according to the present embodiment is a monochrome image forming apparatus using a two-component developing agent including a toner and a magnetic carrier as a developing agent. The toner may be, for example, black color.

A photosensitive drum 1 is an example of an image carrier, on which an electrostatic latent image is formed, and includes a photosensitive layer having a photoconductivity formed on an outer circumference of a cylindrical metal pipe. Instead of using the photosensitive drum 1, a photosensitive belt, in which a photosensitive layer is formed on an outer surface of a circulating belt, may be used.

Around the photosensitive drum 1, a charging roller 2, an exposing unit 3, a developing unit 100, a transfer roller 4, an electric charge eliminator 5, and a cleaning blade 6 are sequentially arranged in a rotating direction of the photosensitive drum 1.

The charging roller 2 is an example of a charger that charges a surface of the photosensitive drum 1 to a uniform charging potential. The charging roller 2 rotates while contacting the photosensitive drum 1, and a charging bias voltage is applied to the charging roller 2. A corona charger that charges the surface of the photosensitive drum 1 by applying a bias voltage between a flat electrode and a wire electrode to cause a corona discharge may be used as the charger.

The exposing unit 3 scans light corresponding to image information onto the surface of the photosensitive drum 1 that is charged to form an electrostatic latent image. A laser scanning unit (LSU) that scans light irradiated from a laser diode onto the photosensitive drum 1 after deflecting the light in a main scanning direction by using a polygon mirror may be used as the exposing unit 3; however, embodiments are not limited thereto.

The developing unit 100 contains a developing agent. The developing unit 100 supplies a toner in the developing agent to the electrostatic latent image formed on the photosensitive drum 1 to form a visible toner image on the surface of the photosensitive drum 1. The developing unit 100 includes a developing roller 10 facing the photosensitive drum 1 and forming a developing agent layer on a surface thereof to supply the developing agent layer to a developing region 9, and a first agitator 20 and a second agitator 30 for agitating the developing agent to supply the developing agent to the developing roller 10. While agitating the developing agent, friction occurs between the toner and the carrier, and thereby charging the toner. The developing roller 10 is a developing member supplying the toner onto the surface of the photosensitive drum 1. The developing roller 10 is located to face the photosensitive drum 1. The developing roller 10 may be spaced apart from the photosensitive drum 1 as much as a developing gap. The developing gap is a gap between the outer circumferential surface of the photosensitive drum 1 and an outer circumferential surface of the developing roller 10 in the developing region 9. The developing gap may be tens to hundreds of micrometer.

The transfer roller 4 is an example of a transfer unit that transfers the toner image formed on the photosensitive drum 1 onto a printing medium. The transfer roller 4 faces the photosensitive drum 1 to form a transfer nip, and a transfer bias voltage is applied to the transfer roller 4. The toner image formed on the surface of the photosensitive drum 1 is transferred onto a recording medium P by a transfer field that is formed between the photosensitive drum 1 and the transfer roller 4 due to the transfer bias voltage. A coroner transfer unit using a corona discharge may be used instead of the transfer roller 4.

The toner remaining on the surface of the photosensitive drum 1 after the transfer is removed by a cleaning blade (cleaning unit 6). The electric charge eliminator 5 that removes remaining potential on the photosensitive drum 1 may be disposed at an upstream side of the cleaning blade 6 based on a rotating direction of the photosensitive drum 1. The electric charge eliminator 5 may irradiate light on the surface of the photosensitive drum 1.

The toner image transferred onto the recording medium P is attached to the recording medium P by an electrostatic force. A fusing unit 7 fuses the toner image on the recording medium P by applying heat and pressure onto the toner image.

Image forming processes according to the above described configuration will be described as follows. When a charging bias voltage is applied to the charging unit 2, the surface of the photosensitive drum 1 is charged to a uniform potential. The exposing unit 3 scans light corresponding to image information onto the surface of the photosensitive drum 1 to form an electrostatic latent image. When a developing bias voltage is applied to the developing roller 10 and a developing field is formed between the developing roller 10 and the photosensitive drum 1, the toner is moved from the developing agent layer formed on the surface of the developing roller 10 to the surface of the photosensitive drum 1 in order to develop the electrostatic latent image. Then, a toner image is formed on the surface of the photosensitive drum 1. A printing medium P is supplied from a paper feeding unit (not shown) to the transfer nip where the photosensitive drum 1 and the transfer roller 4 face each other. The toner image is moved from the surface of the photosensitive drum 1 by the transfer field formed by the transfer bias voltage and attached to the recording medium P. When the recording medium P passes through the fusing unit 7, the toner image is fused in the recording medium P due to the heat and pressure, and then, an image printing operation is finished. The cleaning blade 6 contacts the surface of the photosensitive drum 1 to remove the toner remaining on the surface of the photosensitive drum 1.

Hereinafter, a configuration of the developing unit 100 will be described in detail below.

Figure 2:
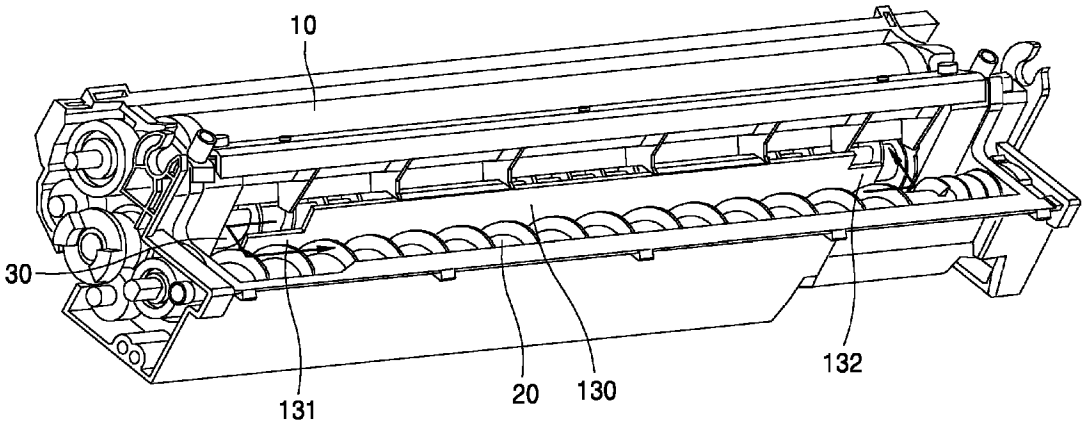
FIG. 2 is a perspective view of a developing unit applied to the electrophotographic image forming apparatus of FIG. 1.

FIG. 2 is a perspective view of the developing unit 100. Referring to FIGS. 1 and 2, the developing unit 100 includes an agitating region where a developing agent is agitated. The agitating region may include a first region 110 in which the first agitator 20 is provided, and a second region 120 in which the second agitator 30 and the developing roller 10 are provided. The first region 110 and the second region 120 are partitioned from each other by a partition wall 130 crossing in a lengthwise direction of the developing roller 10. Openings 131 and 132 are respectively on opposite ends in a length direction of the partition wall 130, that is, the lengthwise direction of the developing roller 10. The first and second regions 110 and 120 are connected to each other through the openings 131 and 132. The first and second agitators 20 and 30 may be, for example, augers having an axis extending in the lengthwise direction of the developing roller 10 and a spiral wing formed on an outer circumference of the axis. When the first agitator 20 rotates, the developing agent in the first region 110 is carried in an axial direction of the first agitator 20 and conveyed to the second region 120 through the opening 132 provided at an end portion of the partition wall 130. In the second region 120, the developing agent is carried in an axial direction of the second agitator 30, that is, an opposite direction to the conveying direction by the first agitator 20, by the second agitator 30, and is conveyed to the first region through the opening 131 provided at the other end of the partition wall 130. Accordingly, the developing agent is circulated along the first region 110 and the second region 120, and is supplied to the developing roller 10 located in the second region 120 while circulating.

Since the toner is developed from the developing roller 10 to the photosensitive drum 1, an amount of the toner in the first and second regions 110 and 120 is reduced. The developing unit 100 may include a toner concentration sensor (not shown) for detecting a concentration of the toner in the developing agent. The toner concentration sensor may be provided, for example, in the first region 110. The toner concentration may be a ratio of a toner weight with respect to a total weight of the developing agent. The toner concentration sensor may be a magnetic sensor that measures an intensity of a magnetic force of the carrier to indirectly detect the toner concentration. When an amount of the carrier is relatively large and the toner amount is relatively small in a detection area of the toner concentration sensor, a magnitude of a magnetic field detected by the magnetic sensor increases, and on the other hand, when the toner amount is relatively large in the detection area, the magnitude of the magnetic field detected by the magnetic sensor is reduced. The magnetic sensor may detect the toner concentration by a relation between the detected magnitude of the magnetic field and the toner concentration. As another example, the toner concentration sensor may be a capacitive sensor for detecting the toner concentration by using a difference between dielectric permittivities of the carrier and the toner. If the toner concentration detected by the toner concentration sensor is less than a reference toner concentration, the toner may be added to the developing unit 100. The toner may be supplied from, for example, a toner container (not shown), into the second region 120. Due to the above operation, the toner concentration in the developing unit 100 may be maintained constantly. The toner container (not shown) may be integrally formed with the developing unit 100. Also, the toner container (not shown) may be replaced separately from the developing unit 100. The reference toner concentration may be set as, for example, 7%; however, embodiments are not limited thereto.

Figure 3:
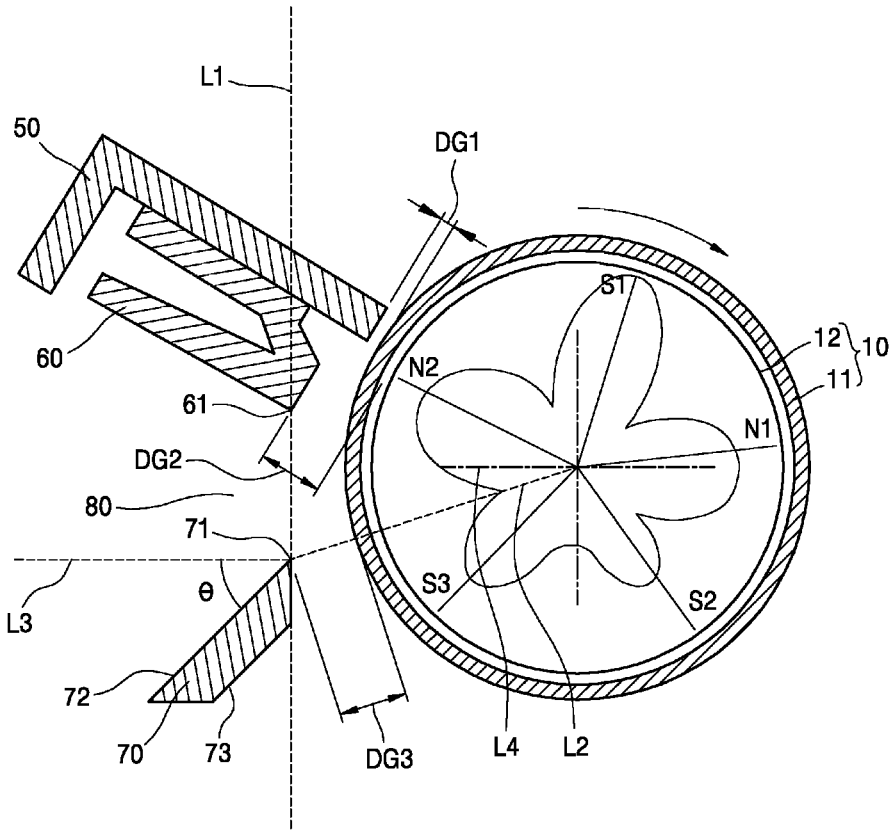
FIG. 3 is a detailed diagram of the developing unit shown in FIG. 1 and FIG. 2.
Figure 4:
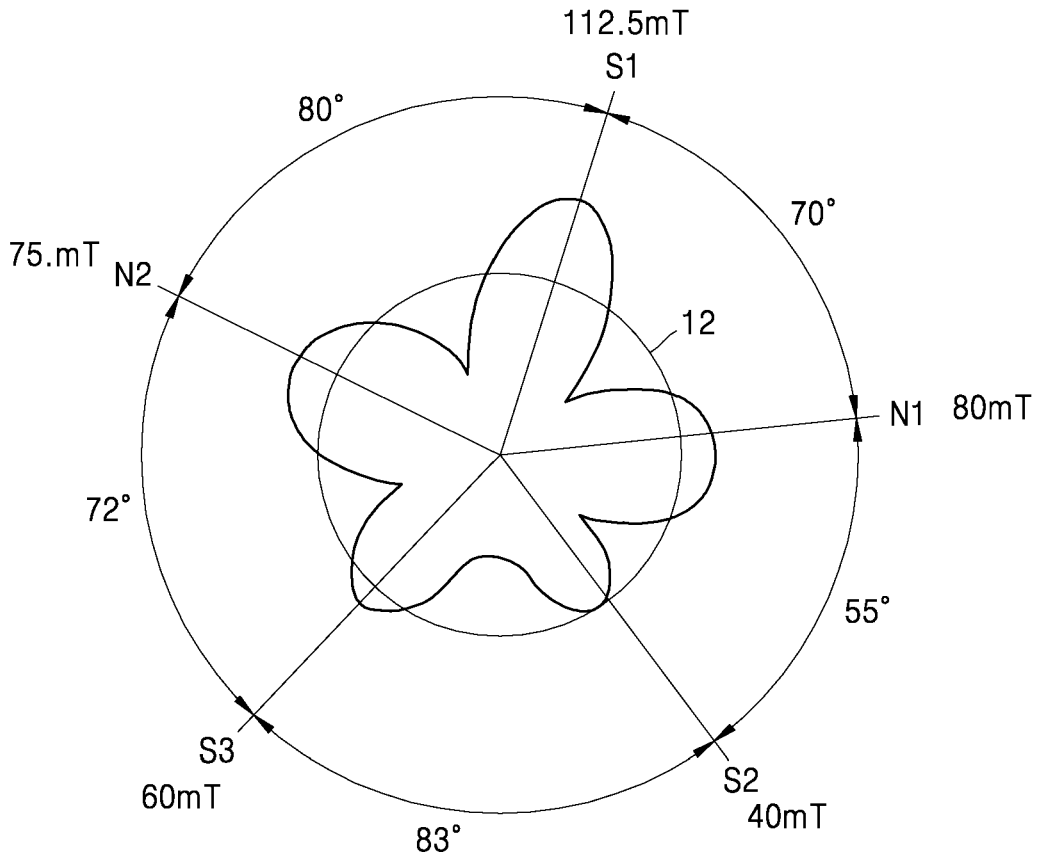
FIG. 4 is a diagram showing a magnet according to an embodiment.

FIG. 3 is a detailed diagram showing a peripheral portion of the developing roller 10 in the developing unit 100, and FIG. 4 is a diagram showing a magnet 12 according to an embodiment. Referring to FIGS. 3 and 4, the developing roller 10 may include a sleeve 11 that rotates, and a magnet (a magnetic pole member) 12 provided in the sleeve 11. The sleeve 11 and the photosensitive drum 1 may rotate in opposite directions to each other. That is, surfaces of the sleeve 11 and the photosensitive drum 1 may move in the same direction in a region where the sleeve 11 and the photosensitive drum 1 face each other. However, embodiments are not limited thereto, that is, the sleeve 11 and the photosensitive drum 1 may rotate in the same direction as each other. The magnet 12 may not rotate. The magnet 12 may include a plurality of magnetic poles. The plurality of magnetic poles may include, for example, a main pole S1 facing the photosensitive drum 1, and a conveying pole N1, a separation pole S2, a catch pole S3, and a regulating pole N2 that are arranged in a rotating direction of the sleeve 11 from the main pole S1.

Referring to FIG. 4, the main pole S1, the conveying pole N1, the separation pole S3, the regulation pole N2, and the main pole S1 are arranged, for example, at angles of 70°, 55°, 83°, 72°, and 80° in the rotating direction of the sleeve 11. In FIG. 3, dotted lines denote distributions of magnetic force of the main pole S1, the conveying pole N1, the separation pole S2, the catch pole S3, and the regulating pole N2 in a vertical direction (radial direction of the developing roller 10), and maximum values of vertical magnetic forces of the poles are, for example, 112.5 mT or higher, 80 mT±6, 42 mT±5, 60 mT±5, and 75 mT±5, respectively. However, FIG. 4 shows an example of the magnet 12, and embodiments are not limited to the above examples.

In the developing agent carried to the second region 120, the carrier is attached to the outer circumference of the developing roller 10 by the magnetic force of the catch pole S3, and the toner is attached to the carrier by the electrostatic force. Then, the developing agent layer including the carrier and the toner is formed on the outer circumference of the developing roller 10.

The regulating member 90 forms a regulating gap with the outer circumference of the developing roller 10 in order to regulate the thickness of the developing agent layer supplied to the developing area 9 to a uniform thickness. The regulating member 90 may include a first regulating member 50 facing the developing roller 10 to form a first regulating gap DG1 between the first regulating member 50 and the outer circumference of the sleeve 11. The first regulating member 50 is located facing to the regulating pole N2. The first regulating member 50 is generally referred to as a doctor blade. The first regulating gap DG1 may be set so that a desired amount of developing agent may be supplied to the developing area 9. The amount of the developing agent supplied to the developing area 9 may be expressed as a weight of the developing agent per unit area on the outer circumference of the developing roller 10, that is, a developer mass per area (DMA). For example, when the first regulating member DG1 is set as about 0.25 to about 0.7 mm, the DMA may be adjusted within a range of about 20 to about 90 mg/cm$^2$. However, embodiments are not limited thereto, the first regulating member DG1 may be appropriately set within a range of, for example, about 0.2 to about 1.5 mm, so that a desired amount of developing agent that is suitable for printing conditions such as a printing speed may be supplied to the developing area 9.

The developing agent layer formed on the outer circumference of the sleeve 11 by the magnetic force of the catch pole S3 is conveyed to the regulating pole N2 according to the rotation of the sleeve 11. The thickness of the developing agent layer is regulated while passing through the first regulating gap DG1. Thus, the developing agent layer of a uniform thickness passes through the first regulating gap DG1, and remaining developing agent is blocked by the first regulating member 50 and recovered to the second region 120. The developing agent layer that is regulated to a uniform thickness is conveyed to the main pole S1 when the sleeve 11 rotates. The main pole S1 is located in the developing area 9 where the sleeve 11 and the photosensitive drum 1 face each other. In the developing area 9, the toner in the developing agent layer formed on the surface of the sleeve 11 is attached to the electrostatic latent image formed on the photosensitive drum 1 due to the developing bias voltage applied to the sleeve 11. The developing agent remaining on the outer circumference of the sleeve 11 after the developing area 9 is conveyed to the separation pole S2 via the conveying pole N1. The developing agent is separated from the outer circumference of the sleeve 11 by a magnetic repulsive force between the separation pole S2 and the adjacent catch pole S3, and then, dropped onto the second region 120. Due to the above circulation structure, the developing agent with a new toner is supplied into the developing area 9.

Figure 11:
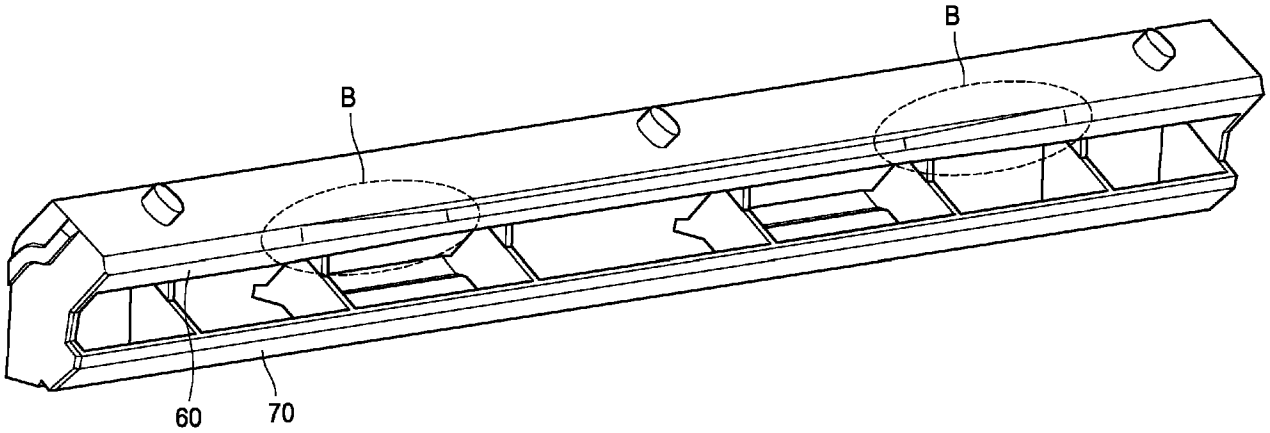
FIG. 11 is a perspective view of a third regulating member according to an embodiment.

In order to obtain printing image with good quality, the thickness of the developing agent layer supplied to the developing area 9 through the first regulating gap DG1 has to be uniform in a length direction of the developing roller 10. Referring to FIGS. 1 and 3, the regulating member 90 may further include a second regulating member 60 disposed at an upstream side of the first regulating member 50 based on a rotating direction of the developing roller 10. The second regulating member 60 faces the regulating pole N2 like the first regulating member 50, and further forms a second regulating gap DG2 with the outer circumference of the developing roller 10. The second regulating gap DG2 is greater than the first regulating gap DG1. In a case where an auger is used as the second agitator 30, a concentration of the developing agent in the second region 120 may not be uniform in a lengthwise direction of the second agitator 30 with a period of a pitch between the spiral wings of the auger, and the non-uniformity of the concentration of the developing agent may affect the developing agent layer that has passed through the first regulating gap DG1. Thus, the thickness of the developing agent layer may be non-uniform in the length direction of the developing roller 10, and an auger mark defect, by which a concentration of the printed image is non-uniform in the length direction of the printing medium, may occur. The second regulating member 60 increases the concentration of the developing agent at an upstream side of the first regulating gap DG1, and thereby forming the developing agent layer having a uniform thickness on the outer circumference of the developing roller 10 after passing through the first regulating gap DG1. The second regulating gap DG2 may be constant in the length direction of the developing roller 10. In addition, when the first regulating member 50 is provided, opposite ends of the first regulating gap DG1 may be smaller than a center portion thereof, and in order to compensate for this, a center portion of the second regulating gap DG2 is set to be greater than opposite ends thereof so that a pressure and a concentration of the developing agent at the upstream side of the first regulating member 50 may be less at the center portion and greater at the opposite ends. In this case, the second regulating gap DG2 may become greater from the opposite ends toward the center portion, and as shown in FIG. 11, may be constant at the opposite ends and the center portion and may be smoothly changed at boundaries B between the center portion and the opposite ends.

The excessive developing agent blocked by the first regulating gap DG1 and the second regulating gap DG2 is pushed away in a direction opposite to the rotating direction of the developing roller 10. The excessive developing agent that is pushed out falls down to the second region 120 due to the gravity when escaping from the magnetic force of the regulating pole N2, and then, is agitated by the second agitator 30 and attached to the developing roller 10 again. Otherwise, the excessive developing agent is circulated to the first region 110, and then, returned to the second region 120 and attached to the developing roller 10. Due to the circulation, fresh developing agent may be supplied to the first and second regulating gaps DG1 and DG2.

However, during dropping down to the second region 120, processes that some of the developing agent is not fall down to the second region 120 but attached to the developing roller 10 by the magnetic force of the catch pole S3, regulated by the first and second regulating members 50 and 60, dropped down due to the gravity when escaping from the magnetic force of the regulating pole N2, and attached to the developing roller 10 again due to the magnetic force of the catch pole S3 may be repeatedly performed. As described above, the developing agent that may not be circulated between the first and second regions 110 and 120, but only circulated between the regulating pole N2 and the catch pole S3 may be referred to as a 'stagnant developing agent'.

If the amount of the stagnant developing agent is increased, the pressure of the developing agent in the first and second regulating gaps DG1 and DG2 is excessively increased, and thus, stress applied to the developing agent may be increased and performance of the developing agent may be degraded. Also, if a time of staying the developing agent between the regulating pole N2 and the catch pole S3 is increased, degradation of the performance of the developing agent may be accelerated due to heat transferred from, for example, the fusing unit 7. The degradation in the performance of the developing agent may cause degradation of the image concentration, unevenness of the image concentration, and toner dispersion.

If the lifespan of the developing agent is over, the developing agent is replaced. The replacement cycle may be expressed as a printing amount. However, if the amount of the stagnant developing agent or the stagnant time is increased, the degradation in the performance of the developing agent is accelerated, and the DMA may be excessively lowered at a last stage of the cycle. In particular, the degradation may be accelerated under high temperature and high humidity.

Figure 5:
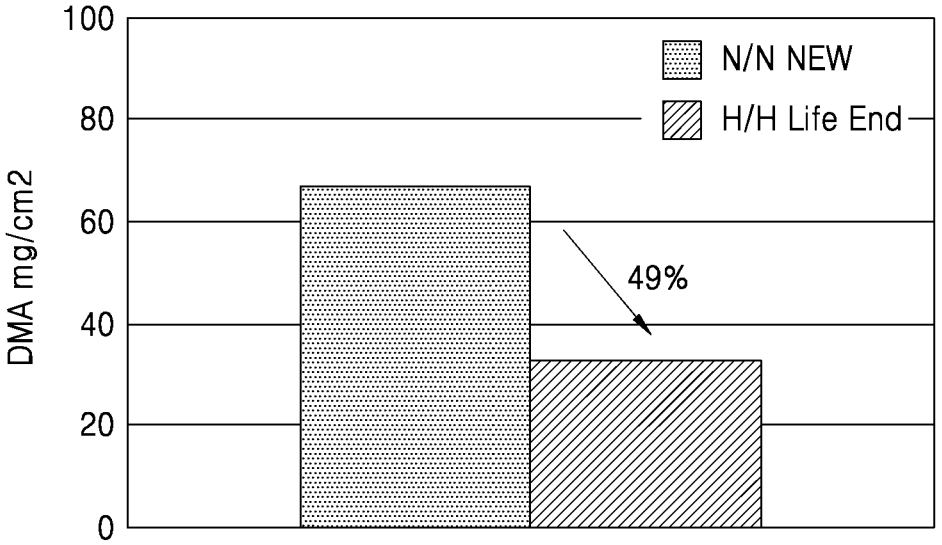
FIG. 5 is a graph showing a result of measuring a change in a developer mass per area (DMA) at an initial stage and a late stage of a stagnant developing agent.

FIG. 5 is a graph showing a result of measuring variation in the DMA at an initial stage and a last stage of the replacement cycle due to the stagnant developing agent. Measurement conditions and results are as follows.

[Measurement Condition]

Diameter of the developing roller 10: 18.2 mm

Amount of the developing agent contained in the developing unit 100: 345 g

Printing speed: 23 ppm (page per minute, A4)

Processing speed: 118 mm/second

Speed ratio between the developing roller 10/photosensitive drum 1: 1.39

Outer diameter of the second agitator 30: 18 mm

Developing gap: 0.4 mm

First regulating gap (DG1): 0.6 mm

Carrier diameter: 38 μm

Toner (polymerized toner) diameter: 6.7 μm

Figure 6:
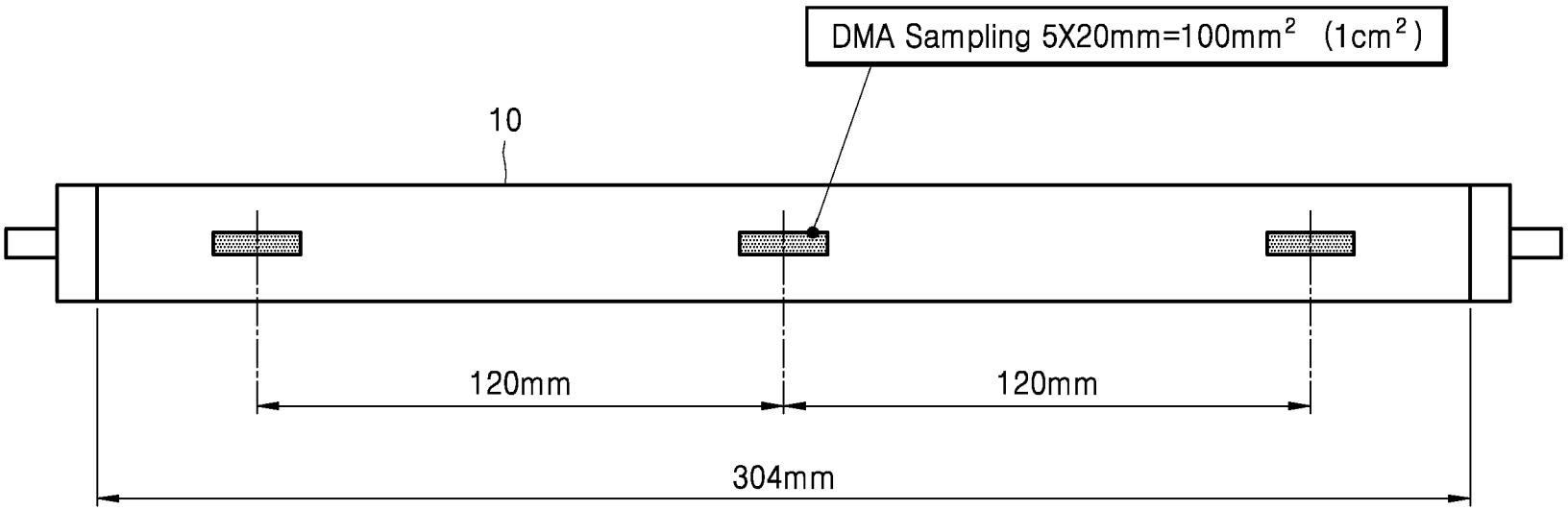
FIG. 6 is a diagram showing an example of a DMA measurement location.

As shown in FIG. 6, the DMA is obtained by measuring weight of the developing agent collected by adhering the developing agent from areas of 5×20 mm at the center portion, and portions 120 mm apart from the center portion toward the opposite ends of the developing roller 10 in a precision balancing method. The measurement value of the DMA is an average of three-times of measurements. A charging amount is a value measured under conditions of an applied voltage 2.8 V, 2000 rpm, and a voltage application time of 30 seconds by using an electric field ratio equation-based charge amount measurement device (made by DIT Co., Ltd.).

[Measurement Result]

(1) initial stage of the cycle (normal temperature/normal humidity, new developing agent)

Toner concentration: 6.7%

Average charging of the developing agent: −70 μC/g

DMA: 67 mg/cm2

(2) Last stage of the cycle (high temperature/high humidity, after printing 80000 sheets)

Toner concentration: 6.0%

Average charging of the developing agent: −25 μC/g

DMA: 33 mg/cm2

As recognized from the above measurement result, the DMA at the last stage of the replacement cycle of the developing agent is lowered to about 49% of the DMA at the initial stage of the cycle. In order to maintain uniform image quality, the DMA has to be maintained uniformly during the replacement cycle of the developing agent. When a difference between the DMA at the last stage of the replacement cycle and the DMA at the initial stage of the replacement cycle of the developing agent is large, it is difficult to obtain the image concentration and the image quality at the same level as that of the initial stage of the replacement cycle even though processing parameters such as the developing bias voltage, the toner concentration, and the exposure amount are controlled. Also, when the DMA is degraded, an amount of air in the developing agent layer supplied to the developing area 9 is increased, thereby increasing an amount of the dispersed toner.

In order to address the rapid degradation of the DMA caused by the stagnant developing agent, referring to FIG. 3, a third regulating member (shielding member) 70 is disposed at an upstream side of the second regulating member 60 so that the developing agent escaping from the magnetic force of the regulating pole N2 may not be attached to the catch pole S3. A downstream end 71 of the third regulating member 70 is separated from the outer circumferential surface of the developing roller 10. Also, the downstream end 71 of the third regulating member 70 is separated from the upstream end 61 of the second regulating member 60. Accordingly, a third regulating gap DG3 is formed between the third regulating member 70 and the outer circumference of the developing roller 10, and a recovery path 80 through which the developing agent blocked by the first and second regulating members 50 and 60 is recovered to the second region 120 is formed between the second regulating member 60 and the third regulating member 70. The amount of the developing agent attached to the outer circumference of the developing roller 10 due to the magnetic force of the catch pole S3 is regulated by the third regulating gap DG3. A gap between the third regulating member 70 and the developing roller 10 is the smallest at the downstream end 71 of the third regulating member 70, and the gap is defined as the third regulating gap DG3.

A vertical line L1 passing through the upstream end 61 of the second regulating member 60 is located at an outside of the outer circumference of the developing roller 10. That is, a distance from a center C of the developing roller 10 to the vertical line L1 is greater than a radius of the developing roller 10. According to the above configuration, when the developing agent blocked by the upstream end 61 of the second regulating member 60 and the developing agent regulated by the first and second regulating gaps DG1 and DG2 and discharged from the second regulating gap DG2 fall down due to the gravity, the developing agent may freely fall down to the second region 120 without being interfered with the outer circumference of the developing roller 10.

Also, the upstream end 61 of the second regulating member 60 is located above a horizontal line L4 crossing the center C of the developing roller 10, and the downstream end 71 of the third regulating member 70 is located below the horizontal line L4. Due to the above configuration, the developing agent attached to the outer circumference of the developing roller 61 is branched at the upstream end 61 of the second regulating member 60, and some of the developing agent is supplied to the second regulating gap DG2 and the other of the developing agent is recovered to the second region 120 via the recovery path 80. Also, the developing agent regulated by the first and second regulating gaps DG1 and DG2 is guided by the downstream end 71 of the third regulating member 70 when falling down after escaping from the magnetic force of the regulating pole N2, and thus, the developing agent is not attached to the developing roller 10 due to the magnetic force of the catch pole S3 and falls down to the second region 120 through the recovery path 80.

In order to reduce the amount of the stagnant developing agent by guiding the developing agent regulated by the first and second regulating gaps DG1 and DG2 to the second region 120, a relative location of the downstream end 71 of the third regulating member 70 with respect to the upstream end 61 of the second regulating member 60 needs to be optimized. Also, the downstream end 71 of the third regulating member 70 has to be located between the regulating pole N2 and the catch pole S3, and a relative location of the downstream end 71 of the third regulating member 70 needs to be optimized with respect to the regulating pole N2 and the catch pole S3.

Figure 7:
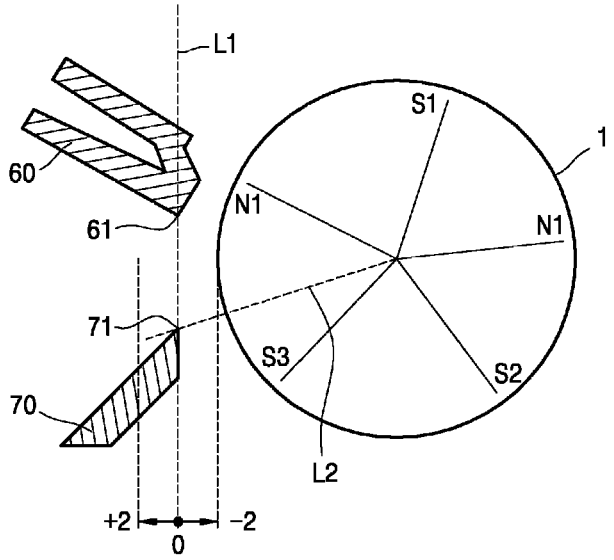
FIG. 7 is a diagram illustrating an experiment for optimizing relative location of a downstream side end of a third regulation member with respect to an upstream side end of a second regulation member.

FIG. 7 is a diagram illustrating an experiment for optimizing the relative location of the downstream end 71 of the third regulating member 70 with respect to the upstream end 61 of the second regulating member 60. Referring to FIG. 7, a reference location is a state where the downstream end 71 of the third regulating member 70 is located at an intersection point between the vertical line L1 and a line L2 connecting the center C of the developing roller 10 and a location where the vertical magnetic force between the catch pole S3 and the regulating pole N2 is minimum. In addition, a circulating speed (or circulating amount) of the developing agent passing through the recovery path 80 is evaluated by visual inspection while moving the downstream end 71 of the third regulating member 70 in a direction perpendicular to the vertical line L1. Experimental results are shown in table 1.

TABLE 1

| | Location of the downstream end 71 of the third regulating member | | | | | | |
|---|---|---|---|---|---|---|---|
| | −3 mm | −2 mm | −1 mm | 0 | +1 mm | +2 mm | +3 mm |
| Circulating speed | — | 4 | 5 | 3 | 2 | 2 | 1 |

The first regulating gap DG1 was 0.6 mm, and the second regulating gap DG2 was 2.5 mm at the center portion and 1.9 mm at opposite end portions. In the table 1, '0' denotes the reference location, minus (−) mark denotes a direction approaching the developing roller 10, and plus (+) mark denotes a direction apart from the developing roller 10. The circulating speed is a relative value with respect to the circulating speed when the downstream end 71 of the third regulating member 70 is located on the vertical line L1, that is, 3. The number greater than 3 denotes that the circulating speed is faster, and the number less than 3 denotes that the circulating speed is slower.

When the circulating speed (or circulating amount) of the developing agent passing through the recovery path 80 is fast (large), the DMA is stabilized and the degradation in the performance of the developing agent may be prevented. According to table 1, when the downstream end 71 of the third regulating member 70 is moved in the negative (−) direction, that is, approaches the developing roller 10, the circulating speed is increased. The circulating speed at a location of −2 mm is slightly less than that of a location of −1 mm because the developing agent moving from the catch pole S3 to the regulating pole N2 is regulated by the third regulating gap DG3. A stabilized DMA was obtained within about ±2 mm range based on the reference location. At a location of −3 mm, the downstream end 71 contacted the outer circumference of the developing roller 10.

Figure 8:
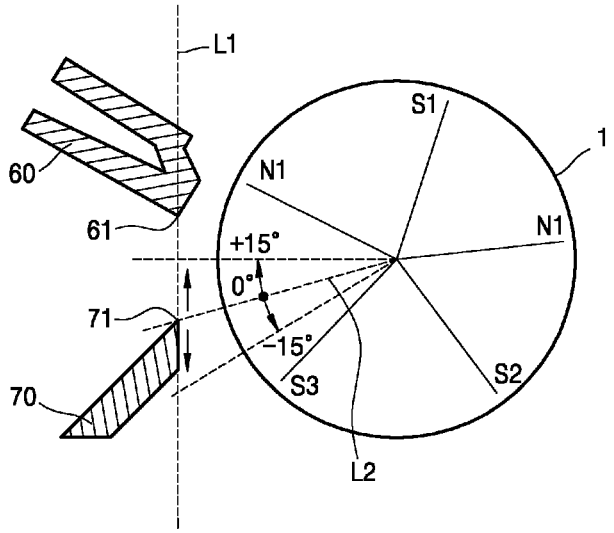
FIG. 8 is a diagram illustrating an experiment for optimizing a relative location of a downstream end of a third regulating member with respect to a regulating pole and a catch pole.

FIG. 8 is a diagram illustrating an experiment for optimizing a relative location of the downstream end 71 of the third regulating member 70 with respect to the regulating pole N2 and the catch pole S3. Referring to FIG. 8, a reference location is a state where the downstream end 71 of the third regulating member 70 is located at an intersection point between the vertical line L1 and a line L2 connecting the center C of the developing roller 10 and a location where the vertical magnetic force between the catch pole S3 and the regulating pole N2 is the minimum. In addition, a circulating speed (or circulating amount) of the developing agent passing through the recovery path 80 is evaluated by visual inspection while moving the downstream end 71 of the third regulating member 70 in a direction of the vertical line L1. Experimental results are shown in table 2.

TABLE 2

| | Location of the downstream end 71 of the third regulating member | | | | | | |
|---|---|---|---|---|---|---|---|
| | −15° | −10° | −5° | 0° | +5° | +10° | +15° |
| Circulating speed | — | 2 | 3 | 3 | 3 | 2 | 1 |

The first regulating gap DG1 was 0.6 mm, and the second regulating gap DG2 was 2.5 mm at the center portion and 1.9 mm at opposite end portions. In table 2, '0° ' denotes the reference location, minus (−) mark denotes a direction approaching the catch pole S3, and plus (+) mark denotes a direction approaching the regulating pole N2. The circulating speed is a relative value with respect to the circulating speed when the downstream end 71 of the third regulating member 70 is located on the intersection point between the vertical line L1 and the line L2, that is, 3. The number greater than 3 denotes that the circulating speed is faster, and the number less than 3 denotes that the circulating speed is slower.

According to table 2, when the downstream end 71 of the third regulating member 70 is disposed within a range of ±10° based on the reference location, a good circulating speed of the developing agent may be obtained, and when the downstream end 71 of the third regulating member 70 is disposed within a range of ±5° based on the reference location, a better circulating speed of the developing agent may be obtained. When the location exceeds +10°, the recovery path 80 is narrow, and the circulating speed of the developing agent is lowered due to the magnetic force of the regulating pole N2. When the location exceeds −10°, the developing agent discharged from the second regulating gap DG2 and dropped starts to be attached to the outer circumference of the developing roller 10 by the magnetic force f the catch pole S3, and thus, the circulating speed is lowered.

Referring back to FIG. 3, the third regulating member 70 includes a guidance surface 72 for guiding the dropped developing agent, and a regulating surface 73 for regulating the developing agent attached to the developing roller 10 by the catch pole S3. An installation angle (0) of the guidance surface 72 is determined so that the developing agent dropped on the guidance surface 72 is not stacked on the guidance surface 72, but is slid naturally by gravity onto the second region 120. When the installation angle (A) of the guidance surface 72 is less than 30° with respect to the horizontal line L3, fluidity of the developing agent is degraded and the developing agent is piled up on the guidance surface 72. Therefore, the installation angle (θ) of the guidance surface 72 may be 30° or greater with respect to the horizontal line L3. In the above experiment, the installation angle (θ) of the guidance surface 72 was set as 50°. Also, an area of the regulating surface 73 is less than that of the guidance surface 72. Accordingly, a contacting area between the developing agent attached to the surface of the developing roller 10 by the magnetic force of the catch pole S3 and the regulating surface 73 may be reduced, and the stress applied to the developing agent may be reduced.

The carrier attached to the developing roller 10 by the magnetic force of the catch pole S3 forms a carrier chain. The carrier chain is elongated in a radial direction thereof when the magnetic force is increased, and the carrier chain is bent toward the surface of the developing roller 10 when the magnetic force is reduced. When the downstream end 71 of the third regulating member 70 is disposed around the reference location where the vertical magnetic force is the lowest, the carrier chain formed on the developing roller 10 is in a sleep status, in which the carrier chain lies on the surface of the developing roller 10. Therefore, a contacting amount of the carrier chain with the third regulating member 70 is reduced, and the stress applied to the developing agent is reduced, and a lot of developing agent may be supplied to the second regulating gap DG2.

Figure 9:
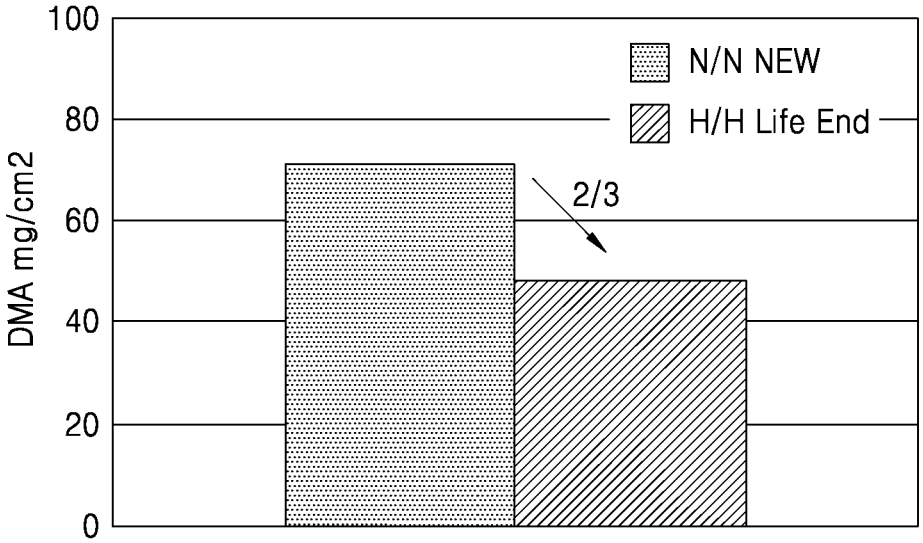
FIG. 9 is a graph showing results of measuring a variation in DMA at initial stage and last stage of a replacement cycle of the developing agent, when a third regulating member is disposed.
Figure 10:
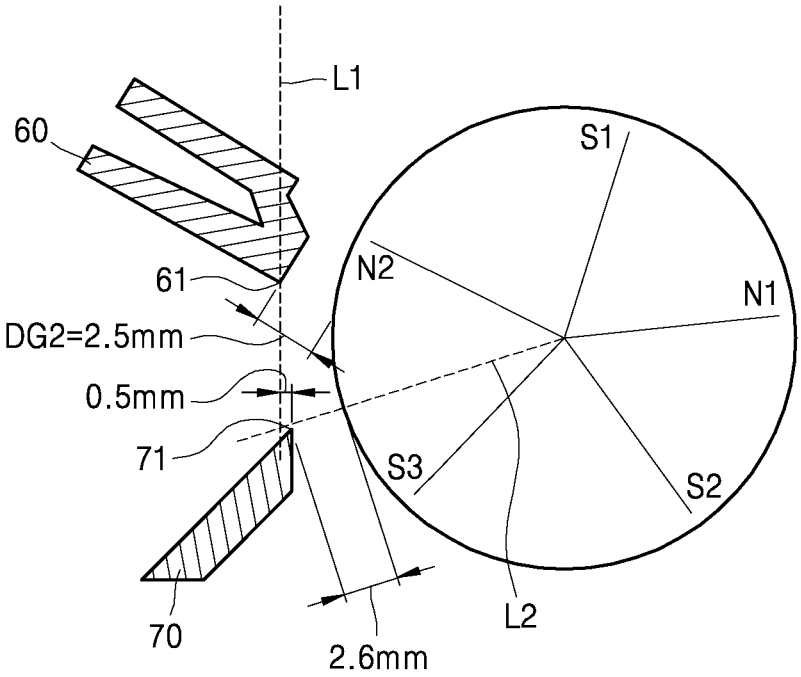
FIG. 10 is a diagram showing conditions for measuring the variation in the DMA at the initial stage and the last stage of the replacement cycle when the third regulating member is disposed.

FIG. 9 is a graph showing a result of measuring a variation in the DMA at the initial stage and the last stage of the replacement cycle of the developing agent when the third regulating member 70 is disposed. FIG. 10 is a diagram showing measurement conditions.

[Measurement Conditions]

Diameter of the developing roller 10: 18.2 mm

Amount of the developing agent contained in the developing unit 100: 255 g

Printing speed: 20 ppm (page per minute, A4)

Processing speed: 90.9 mm/second

Speed ratio between the developing roller 10/photosensitive drum 1: 1.60

Outer diameter of the second agitator 30: 16 mm

Developing gap: 0.4 mm

First regulating gap DG1: 0.6 mm

Carrier diameter: 38 μm

Toner (polymerized toner) diameter: 6.7 μm

Second regulating gap DG2: 2.5 mm (center), 1.9 mm (ends)

Location of the downstream end 71 of the third regulating member 70: 0°

Location of the downstream end 71 of the third regulating member 70 (distance from the vertical line L1): 0.5 mm As shown in FIG. 6, the DMA is obtained by measuring the developing agent by adhering the developing agent from areas of 5×20 mm at the center portion, and portions 120 mm apart from the center portion toward the opposite ends of the developing roller 10 in a precision balancing method. The measurement value of the DMA is an average of three-times of measurements. A charging amount is a value measured under conditions of an applied voltage 2.8 V, 2000 rpm, and a voltage application time of 30 seconds by using an electric field ratio equation-based charge amount measurement device (made by DIT Co., Ltd.).

[Measurement Result]

(1) Initial stage of the replacement cycle (normal temperature/normal humidity, new developing agent)
Toner concentration: 6.5%
Average charging amount of developing agent: −71 μC/g
DMA: 71 mg/cm$^2$ (2) Last stage of the replacement cycle (high temperature/high humidity, after printing 80000 sheets)
Toner concentration: 6.2%
Average charging amount of developing agent: −25 μC/g
DMA: 48 mg/cm$^2$ Referring to the measurement result, the DMA at the last stage of the replacement cycle of the developing agent is about 68% of the DMA at the initial stage of the replacement stage, and thus, is reduced by about 20% when comparing with a case where the third regulating member 70 is not provided. That is, when the third regulating member 70 is disposed, the circulating property of the developing agent may be improved, and thus, the performance degradation of the developing agent is reduced.

As described above, the stagnant developing agent is reduced by disposing the third regulating member 70, and thus, the degradation in the performance of the developing agent caused by the stress or the thermal affect applied to the developing agent may be reduced, thereby maintaining a stabilized image quality during the replacement cycle of the developing agent.

The second regulating member 60 and the third regulating member 70 may be separate units, or may be integrally formed with each other as shown in FIG. 11. Although not shown in the drawings, the first and second regulating members 50 and 60 may be integrally formed with each other.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims and their equivalents.

What is claimed is:

1. A developing unit for supplying a toner in a developing agent, in which the toner and a carrier are mixed, to an electrostatic latent image formed on an image carrier, the developing unit comprising:

an agitating region in which the developing agent is agitated;

a developing member which supplies the toner to the image carrier by attaching the developing agent on an outer circumference thereof, and which comprises a rotating sleeve, and a magnetic pole member including a regulating pole and a catch pole adjacent the regulation pole and disposed on an upstream side of the regulating pole for attaching the developing agent to an outer circumference of the sleeve and disposed inside the sleeve;

a first regulating member which faces the regulating pole to form a first regulating gap between the first regulating member and the outer circumference of the sleeve;

a second regulating member which forms a second regulating gap at an upstream side of the first regulating gap based on a rotating direction of the developing member, between the second regulating member and the outer circumference of the sleeve; and a third regulating member which forms a third regulating gap at an upstream side of the second regulating gap, between the third regulating member and the outer circumference of the sleeve, and which forms a recovery path for recovering excessive developing agent that may not pass through the first and second regulating gaps;

wherein a distance from a center of the developing member to a vertical line passing through an upstream end of the second regulating member is greater than a radius of the developing member, and a downstream end of the third regulating member is located between the regulating pole and the catch pole, and wherein the third regulating member comprises a regulating surface forming the third regulating gap with an outer circumference of the developing member, and a downstream end of the regulating surface is located within a range of ±10° based on a location between the regulating pole and the catch pole at which a magnetic force in a normal direction is lowest.

2. The developing unit of claim 1, wherein a horizontal line passing through the center of the developing member is located between an upstream end of the second regulating member and the downstream end of the third regulating member.

3. The developing unit of claim 1, wherein the downstream end of the third regulating member is disposed within a range of ±2 mm based on the vertical line in a horizontal direction.

4. The developing unit of claim 1, wherein the third regulating member comprises a guidance surface located at an opposite side to the regulating surface for guiding the excessive developing agent to the agitating region, and an angle of the guidance surface with respect to a horizontal line passing through the center of the developing member is 30° or greater.

5. The developing unit of claim 4, wherein an area of the regulating surface is less than an area of the guidance surface.

6. An electrophotographic image forming apparatus using a developing agent, in which a toner and a carrier are mixed, the electrophotographic image forming apparatus comprising:

an image carrier on which an electrostatic latent image is formed; and the developing unit according to claim 1 for supplying the toner to the electrostatic latent image to develop the electrostatic latent image.

7. The electrophotographic image forming apparatus of claim 6, wherein a horizontal line passing through the center of the developing member is located between an upstream end of the second regulating member and a downstream end of the third regulating member.

8. The electrophotographic image forming apparatus of claim 6, wherein the downstream end of the third regulating member is disposed within a range of ±2 mm based on the vertical line in a horizontal direction.

9. The electrophotographic image forming apparatus of claim 6, wherein the third regulating member comprises a regulating surface forming the third regulating gap, and a guidance surface located at an opposite side to the regulating surface for guiding the excessive developing agent to the agitating region, and an angle of the guidance surface with respect to a horizontal line passing through the center of the developing member is 30° or greater.

10. The electrophotographic image forming apparatus of claim 9, wherein an area of the regulating surface is less than an area of the guidance surface.

11. A developing unit for supplying a toner in a developing agent, in which the toner and a carrier are mixed, to an electrostatic latent image formed on an image carrier, the developing unit comprising:

an agitating region in which the developing agent is agitated;

a developing member which supplies the toner to the image carrier by attaching the developing agent on an outer circumference thereof, and which comprises a rotating sleeve, and a magnetic pole member including a regulating pole and a catch pole adiacent the regulation pole and disposed on an upstream side of the regulating pole for attaching the developing agent to an outer circumference of the sleeve and disposed inside the sleeve;

a regulating member which faces the regulating pole, and which forms a regulating gap with the outer circumference of the developing member to regulate a thickness of a developing agent layer supplied to the image carrier; and a shielding member located at an upstream side of the regulating member based on a rotating direction of the sleeve so as to block an excessive developing agent pushed away by the regulating gap not to be attached to the catch pole;

wherein an upstream end of the regulating member is located above a horizontal line that crosses a center of the developing member, and a downstream end of the shielding member is located between the regulating pole and the catch pole and below the horizontal line, and wherein the shielding member comprises a regulating surface forming another regulating gap with the outer circumference of the developing member to regulate an amount of the developing agent attached to the outer circumference of the developing member by the catch pole, and the downstream end of the regulating surface is located within a range of ±10° based on a location between the regulating pole and the catch pole at which a magnetic force in a normal direction is the lowest.

12. The developing unit of claim 11, wherein a distance from the center of the developing member to a vertical line passing through the upstream end of the regulating member is greater than a radius of the developing member.

13. The developing unit of claim 12, wherein the shielding member forms a recovery path, through which the excessive developing agent is guided to the agitating region, between a downstream end of the shielding member and the upstream end of the regulating member.

14. The developing unit of claim 12, wherein the downstream end of the shielding member is disposed within a range of ±2 mm based on the vertical line in a horizontal direction.

15. The developing unit of claim 12, wherein the shielding member comprises a guidance surface located at an opposite side to the regulating surface for guiding the excessive developing agent to the agitating region, and an angle of the guidance surface with respect to the horizontal line is 30° or greater.

16. The developing unit of claim 15, wherein an area of the regulating surface is less than an area of the guidance surface.

17. The developing unit of claim 12, wherein the regulating member comprises a first regulating member facing the regulating pole to form a first regulating gap with the outer circumference of the sleeve, and a second regulating member forming a second regulating gap with the outer circumference of the sleeve at an upstream side of the first regulating gap based on the rotating direction of the developing member.

18. The developing unit of claim 17, wherein the second regulating gap is greater than the first regulating gap.

19. The developing unit of claim 18, wherein a center portion of the second regulating gap in the length direction of the developing member is greater than opposite ends of the second regulating gap.

20. The developing unit of claim 17, wherein the shielding member comprises a guidance surface located at an opposite side to the regulating surface for guiding the excessive developing agent to the agitating region, and an angle of the guidance surface with respect to the horizontal line is 30° or greater.

21. A developing unit for supplying a toner in a developing agent, in which the toner and a carrier are mixed, to an electrostatic latent image formed on an image carrier, the developing unit comprising:

an agitating region in which the developing agent is agitated;

a developing member which supplies the toner to the image carrier by attaching the developing agent on an outer circumference thereof, and which comprises a rotating sleeve, and a magnetic pole member including a regulating pole and a catch pole adjacent the regulation pole and disposed on an upstream side of the regulating pole for attaching the developing agent to an outer circumference of the sleeve and disposed inside the sleeve;

a regulating member which faces the regulating pole to form a regulating gap with the outer circumference of the developing member and to regulate a thickness of a developing agent layer supplied to the image carrier; and another regulating member which is disposed between the regulating pole and the catch pole to form another regulating gap with the outer circumference of the developing member, wherein the another regulating member comprises a regulating surface forming the another regulating gap, and a guidance surface located at an opposite side to the regulating surface for guiding the excessive developing agent to the agitating region, wherein a downstream end of the regulating surface is located with a range of ±10° based on a location between the regulating pole and the catch pole at which a magnetic force in a normal direction is the lowest, and wherein an area of the regulating surface is less than an area of the guidance surface.

* * * * *

UNITED STATES PATENT AND TRADEMARK OFFICE

CERTIFICATE OF CORRECTION

PATENT NO. : 9,207,568 B2
APPLICATION NO. : 14/182518
DATED : December 8, 2015
INVENTOR(S) : Lee et al.

It is certified that error appears in the above-identified patent and that said Letters Patent is hereby corrected as shown below:

In the claims

Claim 11, Column 16, Line 57

Delete “adiacent” and insert --adjacent--

Signed and Sealed this
Twenty-ninth Day of March, 2016

Michelle K. Lee

Michelle K. Lee
*Director of the United States Patent and Trademark Office*